US009070990B2

(12) United States Patent
Flickinger et al.

(10) Patent No.: US 9,070,990 B2
(45) Date of Patent: Jun. 30, 2015

(54) POWER CONNECTOR HAVING OPPOSING CONTACT SPRINGS

(71) Applicant: Tyco Electronics Corporation, Berwyn, PA (US)

(72) Inventors: Steven Lee Flickinger, Hummelstown, PA (US); Evan Charles Wickes, Harrisburg, PA (US); James Charles Shiffler, Hummelstown, PA (US); John L. Broschard, Hershey, PA (US); Steve Douglas Sattazahn, Lebanon, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 135 days.

(21) Appl. No.: 13/898,878

(22) Filed: May 21, 2013

(65) Prior Publication Data

US 2014/0349529 A1 Nov. 27, 2014

(51) Int. Cl.

| | |
|---|---|
| ***H01R 13/02*** | (2006.01) |
| ***H01R 4/48*** | (2006.01) |
| ***H01R 4/10*** | (2006.01) |
| ***H01R 13/11*** | (2006.01) |
| ***H01R 43/16*** | (2006.01) |

(52) U.S. Cl.

CPC .. *H01R 4/48* (2013.01); *H01R 4/10* (2013.01); *H01R 13/113* (2013.01); *H01R 43/16* (2013.01)

(58) Field of Classification Search

CPC ..... H01R 4/48; H01R 4/10; H01R 43/16; H01R 13/113

USPC ..... 439/834, 877, 884, 889

See application file for complete search history.

(56) References Cited

U.S. PATENT DOCUMENTS

| | | | |
|---|---|---|---|
| 4,845,589 | A | 7/1989 | Weidler et al. |
| 4,878,862 | A | 11/1989 | Wise |
| 5,150,513 | A | 9/1992 | Sawdon |
| 5,177,861 | A | 1/1993 | Sawdon |
| 5,618,187 | A | 4/1997 | Goto |
| 6,102,754 | A | 8/2000 | Capper et al. |
| 6,358,094 | B1 | 3/2002 | Belopolsky et al. |
| 2013/0012072 | A1 | 1/2013 | Costello et al. |

FOREIGN PATENT DOCUMENTS

| | | | |
|---|---|---|---|
| DE | 1899448 | U | 8/1964 |
| JP | H11126554 | A | 5/1999 |
| JP | 2002063970 | A | 2/2002 |
| JP | 2004178940 | A | 6/2004 |
| WO | 2004/021521 | A1 | 3/2004 |
| WO | 2013/050299 | A1 | 4/2013 |

OTHER PUBLICATIONS

Drawing #104502 dated Dec. 1989;AMP PDS 125F Series Bus Plug w/guide, electro-mech. Mtg to Mtg plane.

Drawing #104729 dated Aug. 1991; AMP PDS 062 Bus Plug w/guide.

European Search Report issued in corresponding EP Application No. 14168118, mailed on Sep. 25, 2014.

*Primary Examiner* — Khiem Nguyen

(57) ABSTRACT

Power connector including a pair of discrete contact springs configured to electrically engage a conductive component. Each of the contact springs includes a contact body having opposite inner and outer side surfaces and a contact edge that extends between the inner and outer side surfaces. The contact body is shaped to form a spring base and a mating portion. The spring bases of the contact springs are joined by a locking feature. The locking feature includes a localized portion of at least one of the spring bases. The localized portion frictionally engages the other spring base to interlock the spring bases. Each of the mating portions extends from the corresponding spring base. The mating portions are separated by a receiving space and are configured to engage the conductive component when the conductive component is inserted into the receiving space.

20 Claims, 5 Drawing Sheets

POWER CONNECTOR HAVING OPPOSING CONTACT SPRINGS

BACKGROUND OF THE INVENTION

The subject matter described and/or illustrated herein relates generally to a power connector having a pair of contact springs that oppose each other with a receiving space therebetween.

In some electrical systems, power is delivered to a circuit board or other electrical component through a busbar and a power connector. A busbar typically comprises a planar body of conductive material (e.g., copper) having opposite sides that are configured to be engaged by the power connector. To this end, existing power connectors include a pair of contact springs that oppose each other with a receiving space therebetween. The busbar is configured to be inserted into the receiving space. As the busbar is inserted, the contact springs engage the busbar and are deflected away from each other by the busbar. When the power connector and the busbar are operatively coupled, each of the contact springs is biased against one of the sides of the busbar.

The contact springs of conventional power connectors are typically formed from a common piece of conductive sheet material (e.g., copper), which is hereinafter referred to as a "contact blank." The contact blank may be stamped from a larger piece of sheet material. The contact blank includes the contact springs and a joint portion that joins the contact springs. The contact blank is folded along the joint portion so that the two contact springs are properly positioned with the receiving space therebetween.

However, contact springs that are shaped from the same contact blank may have certain limitations. In some instances, the method of manufacturing the contact springs from a common contact blank may be relatively costly. For example, due to the dimensions of the contact blank, it may be difficult to selectively plate the contact springs using a strip-plating process. Consequently, the process that is used to plate the contact springs may apply an excessive amount of plating material (e.g., silver). In addition, the dimensions of the contact blanks may not be suitable for a manufacturing process known as reel-to-reel processing. In reel-to-reel processing, a sheet that includes the stamped contact blanks is reeled from a payoff reel to a take-up reel. While moving between the reels, the stamped blanks may undergo a number of modifications for shaping and plating the contact springs. Processes that use reeling may be less costly and time-consuming than manufacturing processes that do not use reeling. Contact springs that are formed from a common contact blank, however, may not be suitable for reel-to-reel processing.

Accordingly, a need exists for contact springs that may be used in power connectors and that may be manufactured through less expensive methods than conventional contact springs that are formed from a common contact blank.

BRIEF DESCRIPTION OF THE INVENTION

In one embodiment, a power connector is provided that includes a pair of discrete contact springs that are configured to electrically engage a conductive component. Each of the contact springs includes a contact body having opposite inner and outer side surfaces and a contact edge that extends between the inner and outer side surfaces. The contact body is shaped to form a spring base and a mating portion. The spring bases of the contact springs are joined by a locking feature. The locking feature includes a localized portion of at least one of the spring bases. The localized portion frictionally engages the other spring base to interlock the spring bases. Each of the mating portions extends from the corresponding spring base. The mating portions are separated by a receiving space and are configured to engage the conductive component when the conductive component is inserted into the receiving space.

In some cases, a plurality of the locking features may be used to join the spring bases. For example, at least two of the locking features may be proximate to a base seam that is formed by the spring bases. The mating portions may extend from the base seam.

The pair of contact springs may include first and second contact springs. The first contact spring may have a body projection that is formed from the localized portion. The spring base of the second contact spring may include a body recess. The body projection may extend into the body recess and directly engage the spring base of the second contact spring to interlock the spring bases. The body projection may frictionally engage a surface that defines the body recess. In some cases, the body recess may have a recess opening along the inner side surface of the second contact spring. The body projection may have a distal punch profile that is greater than the recess opening to prevent removal of the body projection.

In other embodiments, the body recess may be a window. In such cases, the body projection may extend through the window and directly engage the outer side surface of the second contact spring.

In particular embodiments, the locking feature is a co-punched feature in which the spring base of the first contact spring is punched into the spring base of the second contact spring to form the locking feature. In some embodiments, the contact springs are shaped from corresponding contact blanks that have identical profiles.

In another embodiment, a power connector is provided that includes discrete first and second contact springs that are configured to electrically engage a conductive component. Each of the first and second contact springs includes a contact body having opposite inner and outer side surfaces and a contact edge that extends between the inner and outer side surfaces. The inner side surfaces of the first and second contact springs are positioned side-by-side along an interface. The first and second contact springs are joined by a plurality of co-punched locking features. Each of the co-punched locking features includes a localized portion of one of the first and second contact springs that is stamped into and deforms a localized portion of the other of the first and second contact springs. Optionally, the localized portions do not include the contact edge of the corresponding contact body.

DETAILED DESCRIPTION OF THE INVENTION

Embodiments described herein include power connectors and electrical systems having contact springs that are configured to engage a common conductive component (e.g., busbar, electrical contact, or electrically common contacts) for the transmission of electrical power. The contact springs are discrete elements that are secured to each other such that the contact springs are interlocked. In particular embodiments, the contact springs include one or more locking features in which a localized portion of a first contact spring is directly coupled to a second contact spring such that the first and second contact springs are interlocked. The localized portion represents a portion of the first contact spring that is deformed (e.g., bent, punched, and the like) to engage the second contact spring. In particular embodiments, the localized portion does not include an outer edge that defines a profile of the corresponding contact spring. In other words, an outer edge of the contact spring may not be deformed or moved when the locking feature is created.

After deformation, the localized portion may be a body projection (e.g., protrusion, tab, and the like) that frictionally engages the other contact spring. For example, a protrusion of a first contact spring may be inserted into a recess of the second contact spring and form an interference fit with a surface that defines the recess. The frictional engagement may also occur when a tab of the first contact spring is bent (e.g., folded over) to grip a portion of the second contact spring. The frictional engagement may be configured to maintain the interlocked relationship of the contact springs during a mating operation in which the conductive component engages the contact springs.

Figure 1:
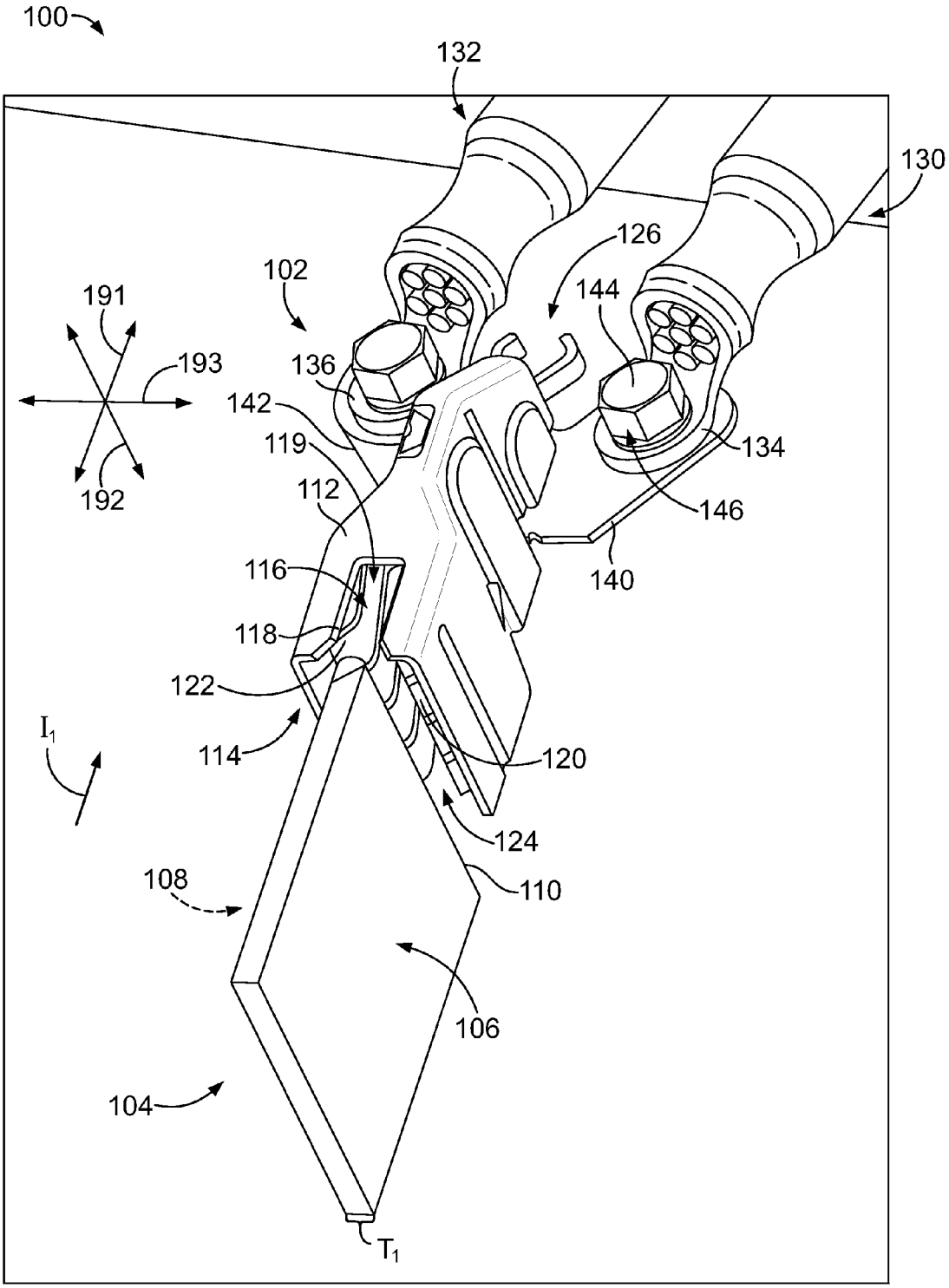
FIG. 1 is a perspective view of an electrical system including a power connector formed in accordance with one embodiment.

FIG. 1 is a perspective view of an electrical system 100 formed in accordance with one embodiment. In FIG. 1, the electrical system 100 and its various components are oriented with respect to mutually perpendicular axes 191-193 that include a mating axis 191, an elevation (or vertical) axis 192, and a lateral (or horizontal) axis 193. Although in some embodiments the elevation axis 192 may extend along a gravitational force direction, embodiments described herein are not required to have any particular orientation with respect to gravity. In the illustrated embodiment, the electrical system 100 includes a power connector 102 and a conductive component 104 that is configured to deliver electrical power to the power connector 102 or receive electrical power from the power connector 102.

In the illustrated embodiment, the conductive component 104 has a substantially planar body that includes opposite sides 106, 108 and a leading edge 110. A uniform thickness $T_1$ of the conductive component 104 may extend between the sides 106, 108. By way of example, the conductive component 104 may be a busbar. As shown in FIG. 1, the conductive component 104 is oriented to extend along a plane that extends parallel to the mating and elevation axes 191, 192. In other embodiments, the conductive component 104 may be another element that is capable of transmitting electrical power. For example, the conductive component 104 may be one or more electrical contacts. The conductive component 104 may be configured to transmit, for example, at least 200 A.

The power connector 102 includes an electrically insulative connector housing or shroud 112 having a mating end 114 and a contact cavity 116. The connector housing 112 has an opening or slot 118 at the mating end 114 that permits insertion of the conductive component 104 into the contact cavity 116. The power connector 102 also has a contact assembly 119 located within the contact cavity 116. The contact assembly 119 includes contact springs 120, 122 that are configured to electrically engage the conductive component 104. The contact springs 120, 122 are disposed within the contact cavity 116. More specifically, the contact springs 120, 122 are separated from each other with a receiving space 124 therebetween. The contact spring 120 is configured to engage the side 106, and the contact spring 122 is configured to engage the side 108.

In an exemplary embodiment, the contact springs 120, 122 are discrete elements that are mechanically joined together to engage the conductive component 104. The contact springs 120, 122 are electrically common. As used herein, the term "discrete" means that the corresponding elements are distinct and separate elements. For example, the contact springs 120, 122 are not shaped from a common piece of sheet material. Instead, each of the contact springs 120, 122 may be individually stamped-and-formed from sheet material and then subsequently joined. The joining operation may include, for example, forming a frictional engagement (e.g., interference fit, snap fit, and the like) to secure the contact springs 120, 122 to each other. In some embodiments, the joining operation may be irreversible such that it would be necessary to damage the contact springs 120, 122 to separate them. In certain embodiments, the contact springs 120, 122 are neither joined with fastening hardware (e.g., screws, bolts, plugs, and the like) nor joined by melting/welding portions of the contact springs 120, 122 together.

During the mating operation, the leading edge 110 of the conductive component 104 is moved in an insertion direction $I_1$ along the mating axis 191 and advanced through the opening 118 and into the receiving space 124 between the contact springs 120, 122. The contact springs 120, 122 may engage the conductive component 104 and be deflected away from each other. More specifically, the contact springs 120, 122 may be deflected in opposite directions along the lateral axis 193. The contact springs 120, 122 slide along and press against the respective sides 106, 108. During the mating operation, the conductive component 104 may engage the connector housing 112. The opening 118 may be shaped such that the connector housing 112 directs the conductive component 104 into a suitable orientation for engaging the contact springs 120, 122.

The contact assembly 119 is configured to be electrically coupled to a power supply, such as power cables 130, 132. For example, as shown in FIG. 1, the power connector 102 has a loading end 126 that is opposite the mating end 114. The contact springs 120, 122 have mounting portions 140, 142, respectively, that are located proximate to the loading end 126. The contact springs 120, 122 are coupled to the power cables 130, 132, respectively, at corresponding terminals 134, 136. The terminals 134, 136 are illustrated as ring terminals, although other types of terminals or methods for terminating may be used. More specifically, the terminals 134, 136 may be directly coupled to the mounting portions 140, 142, respectively. As shown, the terminals 134, 136 may be sandwiched between the respective mounting portion and a head 144 or other feature of a fastener 146. In other embodiments, the power supply may be a circuit board, bus bar, or other component (not shown) to which the mounting portions 140, 142 are directly mounted.

In FIG. 1, the power connector 102 has an offset right-angle configuration in which the mounting portions 140, 142 are mounted to a surface (not shown) that faces in a direction that is perpendicular to the insertion direction $I_1$. More specifically, the mounting portions 140, 142 extend parallel to a plane defined by the mating and lateral axes 191, 193. However, alternative mounting configurations may be used in other embodiments. For example, the mounting portions may have an in-line configuration in which the mounting portions extend along or parallel to the plane defined by the mating and elevation axes 191, 192. As another example, the mounting portions may be oriented to extend parallel to a plane defined by the elevation and lateral axes 192, 193.

Figure 2:
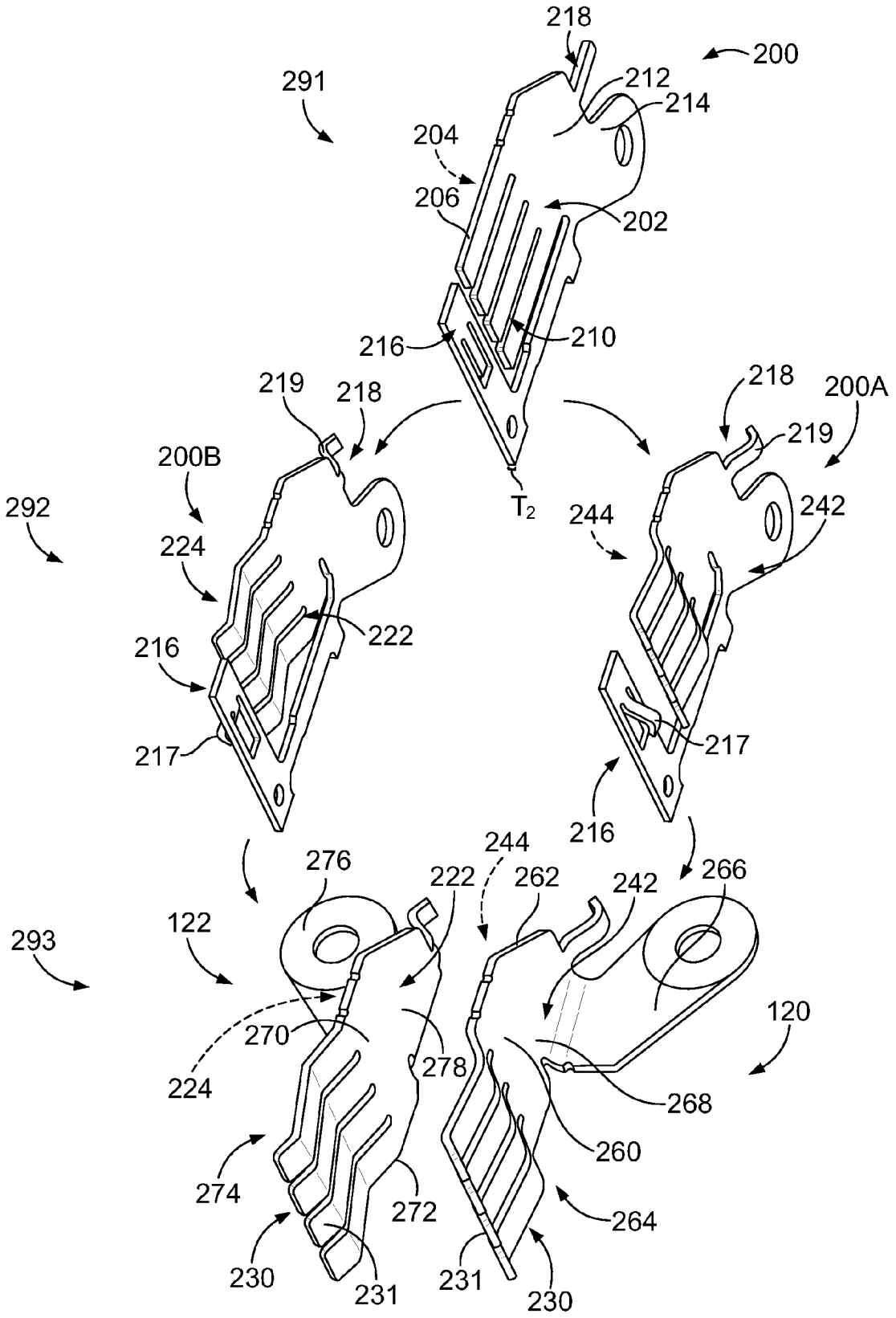
FIG. 2 illustrates different stages of producing discrete contact springs that may be used by the power connector of FIG. 1.

FIG. 2 illustrates different stages 291-293 of manufacture of the contact springs 120, 122. At stage 291, a contact blank 200 is provided by stamping the contact blank 200 from conductive sheet material (not shown), such as sheet metal. The contact blank 200 has a first side surface 202, a second side surface 204, and an outer stamped edge 206 that extends between the first and second side surfaces 202, 204. The stamped edge 206 may include or define a thickness $T_2$ of the contact blank 200. A path of the stamped edge 206 forms a contact profile of the contact blank 200.

The contact blank 200 includes unformed (e.g., non-shaped) portions of the contact springs 120, 122. For example, the contact blank 200 includes a plurality of blank beams 210, a base feature 212, a mounting feature 214, and carrier standoffs 216, 218. Although not shown, portions of the stamped edge 206 may remain coupled or attached to other contact blanks 200 during manufacture of the contact springs. More specifically, multiple contact blanks 200 may be stamped from a single roll of sheet metal. The contact blanks 200 may remain attached to each other during at least one or more stages of manufacture.

As illustrated in FIG. 2, each of the contact springs 120, 122 may be formed from the contact blanks 200. More specifically, the contact springs 120, 122 may be formed from two contact blanks that have identical profiles. In alternative embodiments, however, the contact blank 200 may be configured to be formed into only one of the contact springs and the other contact spring may be formed from a contact blank (not shown) that has a different profile.

At stage 292, the contact blank 200 may be shaped into either a partially-shaped contact blank 200A or a partially-shaped contact blank 200B. At stage 293, the contact blank 200A is further shaped and stamped to become the contact spring 120, and the contact blank 200B is further shaped and stamped to become the contact spring 122. With respect to the contact blank 200A, the first and second side surfaces 202, 204 become outer and inner side surfaces 242, 244 of the contact spring 120. With respect to the contact blank 200B, the first and second side surfaces 202, 204 become inner and outer side surfaces 222, 224.

As shown with respect to the partially-formed contact blanks 200A, 200B, the carrier standoffs 216, 218 may include reference projections 217, 219. The reference projections 217, 219 may be used to facilitate maintaining the shape of the contact beams during the reeling process. However, the reference projections 217, 219 may be used for other purposes, such as facilitating the attachment of the connector housing 112 (FIG. 1) to the contact springs 120, 122 (FIG. 1).

With respect to stage 293, the contact spring 120 includes a contact body 260 having the opposite inner and outer side surfaces 244, 242 and a contact edge 262 that extends between the inner and outer side surfaces 244, 242. The contact body 260 is shaped to include a mating portion 264, a mounting portion 266, and a spring base 268 that joins the mating and mounting portions 264, 266. Likewise, the contact spring 122 includes a contact body 270 having the opposite inner and outer side surfaces 222, 224 and a contact edge 272 that extends between the inner and outer side surfaces 222, 224. The contact body 270 is shaped to include a mating portion 274, a mounting portion 276, and a spring base 278 that joins the mating and mounting portions 274, 276. As described herein, the spring bases 268 and 278 are configured to be mechanically joined to each other to interlock the contact springs 120, 122.

The mating portions 264, 274 include contact fingers 230. The contact fingers 230 are shaped from the blank beams 210 and are configured to resiliently engage a corresponding side of the conductive component 104 (FIG. 1). At some point during the manufacture of the contact springs 120, 122, such as before, during, or after the stages 292 and 293, a plating material may be applied to the blank beams 210 (or the contact fingers 230). In particular embodiments, the plating material is applied using a selective strip-plating process. For example, silver or other plating material may be applied to the inner side surfaces 222, 244 along the contact fingers 230 or, more specifically, distal ends 231 of the contact fingers 230.

Figure 3:
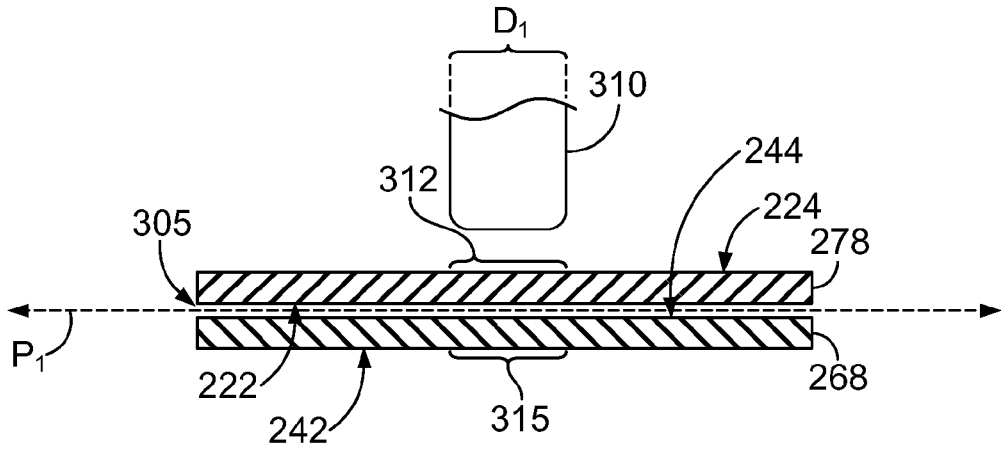
FIG. 3 illustrates a cross-section that includes portions of the contact springs before a joining operation.
Figure 4:
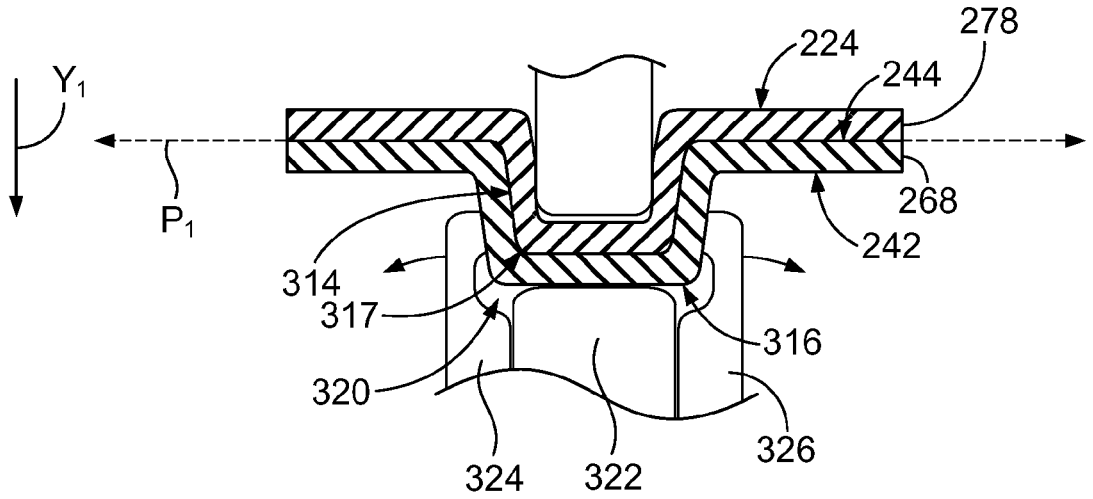
FIG. 4 illustrates a cross-section that includes the portions of the contact springs during the joining operation.
Figure 5:
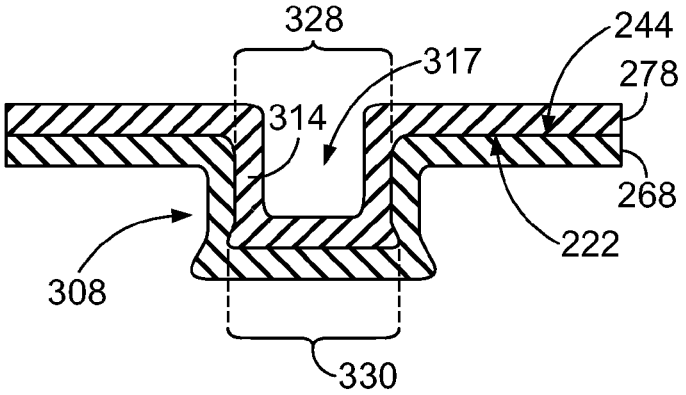
FIG. 5 illustrates a cross-section that includes the portions of the contact springs when the joining operation is complete.

FIGS. 3-5 illustrate cross-sectional views of the spring bases 278, 268 before, during, and after a joining operation, respectively. The joining operation creates a co-punched locking feature 308 (shown in FIG. 5) that secures the spring bases 278, 268 together. To form the locking feature 308, the spring bases 278, 268 may be stacked side-by-side along an interface 305 as shown in FIG. 3. For illustrative purposes, a gap is shown between the spring bases 278, 268 along the interface 305. It is understood, however, that the spring bases 278, 268 may directly abut each other along the interface 305 (e.g., as shown in FIGS. 4 and 5) prior to the joining operation. More specifically, the inner side surfaces 222, 244 may directly abut each other. The outer side surfaces 224, 242 face away from the interface 305.

As shown in FIG. 3, an interface plane $P_1$ extends between the spring bases 278, 268 along the interface 305. A punch element 310 may be positioned adjacent to the outer side surface 224 of the spring base 278. In an exemplary embodiment, the punch element 310 has a circular cross-section, but other cross-sections may be used. The punch element 310 has an outer dimension $D_1$, which can be a diameter of a circle in some embodiments. In FIG. 3, the punch element 310 is configured to deform a localized portion 312 of the spring base 278. In the illustrated embodiment, the localized portion 312 is configured to engage a similarly sized localized portion 315 of the spring base 268 when the localized portion 312 is deformed by the punch element 310.

As shown in FIG. 4, during the joining operation, the punch element 310 is driven (e.g., punched) in a punching direction $Y_1$ into the outer side surface 224 at the spring base 278 and toward the spring base 268. The localized portion 312 (FIG. 3) of the spring base 278 is deformed to create a body projection 314 that projects from the remainder of the spring base 278 (e.g., the portion of the spring base 278 that is not deformed by the punch element 310). The body projection 314 clears the interface plane $P_1$. Driven by the punch element 310, the body projection 314 also deforms the localized portion 315 (FIG. 3) of the spring base 268 to create a body projection 316 having a body recess 317. The body recess 317 is defined by the deformed portion of the inner side surface 244.

In addition to the punch element 310, a punching machine (not shown) used to create the locking feature 308 may include an anvil 322 and movable arms 324, 326 that define a chamber 320. Although not shown, a die may also be located along the side surface 242 to support the spring bases 268, 278 during the punching process. A hole (not shown) in the die may permit the locking feature 308 to be punched therethrough. The localized portion 315 of the spring base 268 is driven into the chamber 320 when deformed by the punch element 310. The anvil 322 is located such that the outer side surface 242 engages the anvil 322. When the outer side surface 242 engages the anvil 322 such that the localized portion 315 (or the body projection 316) may no longer move in the punching direction $Y_1$, the localized portion 315 (or the body projection 316) deforms radially outward in directions that are transverse to the punching direction $Y_1$. The movable arms 324, 326 are configured to permit the lateral deformation. More specifically, the arms 324, 326 are configured to move or rotate away from punch element 310 as indicated in FIG. 4.

With respect to FIG. 5, the body recess 317 defined by the inner side surface 244 of the spring base 268 has a recess opening 328 along the inner side surface 244. The body projection 314 has a distal punch profile 330 along the inner side surface 222. Due to the lateral deformation described above, the punch profile 330 is dimensioned greater than the recess opening 328. As such, the inner side surfaces 222, 244 frictionally engage each other to prevent removal of the body projection 314 from the body recess 317.

Although only one locking feature 308 is shown in FIG. 5, other embodiments may include multiple co-punched locking features. The multiple locking features may be identical to each other in size and shape. In other embodiments, the locking features may be different. For example, the locking feature 308 is formed by deforming the localized portions 312, 315 in the punching direction $Y_1$. In some embodiments, however, one or more locking features may be formed by deforming other localized portions of the spring bases 278, 268 in a direction that is opposite the punching direction $Y_1$. Yet still in other embodiments, a plurality of co-punched locking features may have different dimensions with respect to each other.

Figure 6:
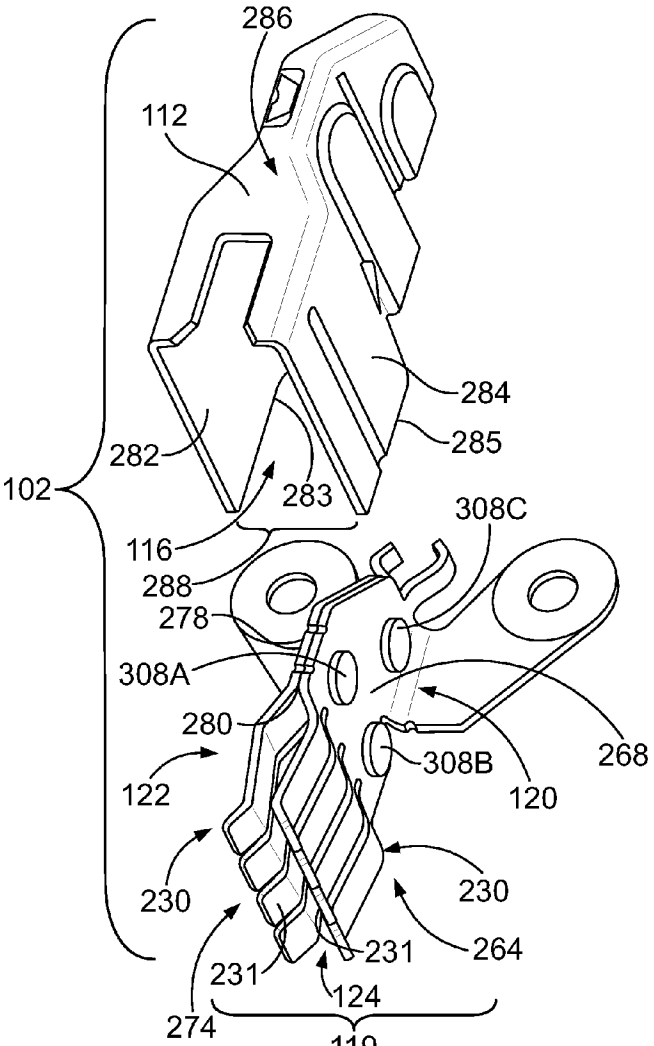
FIG. 6 is an exploded view of the power connector in accordance with one embodiment.

FIG. 6 is an exploded view of the power connector 102. In the illustrated embodiment, the joined contact springs 120, 122 constitute the contact assembly 119. The contact assembly 119 includes a plurality of the co-punched locking features 308A-308C. As shown, when the spring bases 268, 278 are joined, the spring bases 268, 278 define a base seam 280 therebetween. The mating portions 264, 274 extend from the base seam 280 toward the distal ends 231 of the contact fingers 230. At least two of the locking features 308A, 308B are located proximate to the base seam 280. The locking features 308A, 308B are configured to prevent contact springs 120, 122 from separating. More specifically, when the conductive component 104 (FIG. 1) is inserted into the receiving space 124, the contact fingers 230 of the mating portions 264, 274 are deflected away from each other by the conductive component 104. The locking features 308A, 308B are configured to prevent the spring bases 268, 278 from separating along the base seam 280.

The contact cavity 116 of the connector housing 112 is dimensioned to receive the contact assembly 119. In the illustrated embodiment, the contact cavity 116 is configured to receive the mating portions 264, 274 and the spring bases 268, 278. The connector housing 112 includes opposite sidewalls 282, 284 and a top wall 286 that extends between and joins the sidewalls 282, 284. The sidewalls 282, 284 include edges 283, 285, respectively, that define a cavity opening 288. The cavity opening 288 is dimensioned to receive the contact assembly 119 when the connector housing 112 is mounted onto the contact assembly 119.

Figure 7:
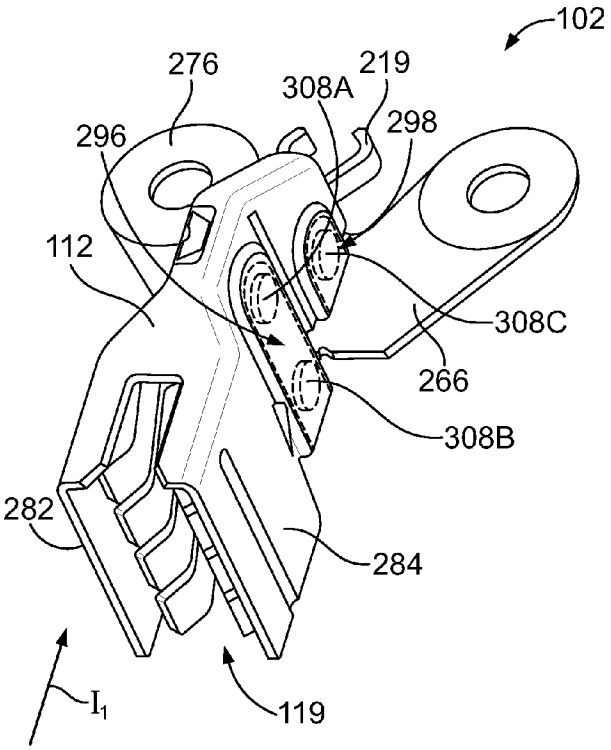
FIG. 7 is a perspective view of the power connector in accordance with one embodiment.

FIG. 7 is a perspective view of the power connector 102. As shown, when the power connector 102 is assembled, the connector housing 112 is positioned over the mounting portions 266, 276. In the illustrated embodiment, the mounting portions 266, 276 project in opposite directions generally away from the connector housing 112. However, as discussed above, the mounting portions 266, 276 may be configured differently in alternative embodiments.

In some embodiments, the connector housing 112 is shaped relative to the contact assembly 119 to prevent movement of the connector housing 112 during a mating operation. For example, the sidewalls 282, 284 may define channels 296, 298 (indicated in phantom in FIG. 7). The channel 296 is sized and shaped to receive the locking features 308A, 308B when the connector housing 112 is mounted onto the contact assembly 119, and the channel 298 is sized and shaped to receive the locking feature 308C. The channels 296, 298 are defined by interior surfaces of the connector housing 112. In some embodiments, the interior surfaces may function as positive stops that prevent the connector housing 112 from moving in the insertion direction $I_1$. In particular, if the conductive component 104 (FIG. 1) engages the connector housing 112 during the mating operation, the relative dimensions of the connector housing 112 and the locking features 308A-308C may prevent the connector housing 112 from moving with respect to the contact assembly 119. In some embodiments, the reference projections 219 may also be configured to engage an edge (not shown) of the connector housing 112 and prevent moving in the insertion direction $I_1$.

Figure 8:
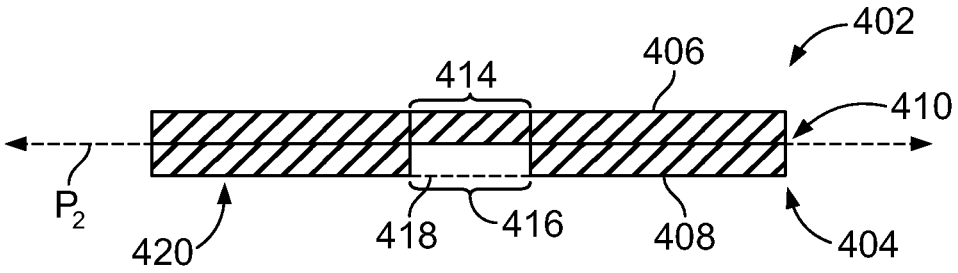
FIG. 8 illustrates a cross-section that includes portions of contact springs before a joining operation.
Figure 9:
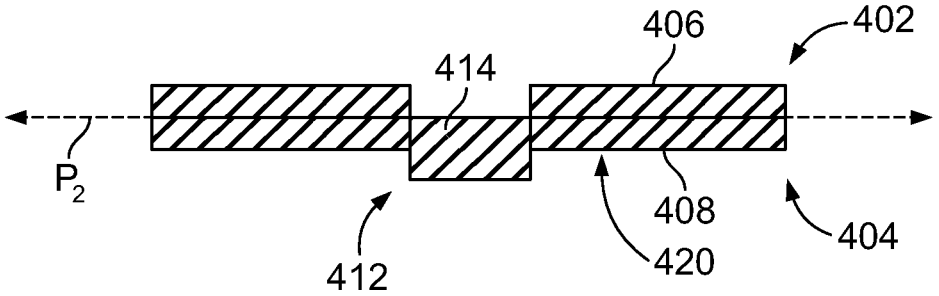
FIG. 9 illustrates a cross-section that includes the portions of the contact springs of FIG. 8 after a joining operation.

FIGS. 8 and 9 illustrate cross-sections of contact springs 402, 404 before and after a joining operation, respectively. The contact springs 402, 404 may have similar features and elements as the contact springs 120, 122 (FIG. 1). For example, the contact springs 402, 404 include spring bases 406, 408, respectively, that are positioned side-by-side along an interface 410. The interface 410 may extend along an interface plane $P_2$.

The joining operation is configured to create a locking feature 412 (FIG. 9). To this end, the spring base 406 includes a localized portion 414, and the spring base 408 includes a window or aperture 416 (FIG. 8) that is defined by an edge 418 (FIG. 8) (indicated by dashed lines). The localized portion 414 may be a tab that is stamped from the spring base 406. During the joining operation, the localized portion 414 is bent into and through the window 416 such that the localized portion 414 clears the interface plane $P_2$. When projecting through the window 416, the localized portion 414 may be referred to as a body projection. The localized portion 414 may be folded over the edge 418 to engage (e.g., grip) an outer side surface 420 of the spring base 408.

Figure 10:
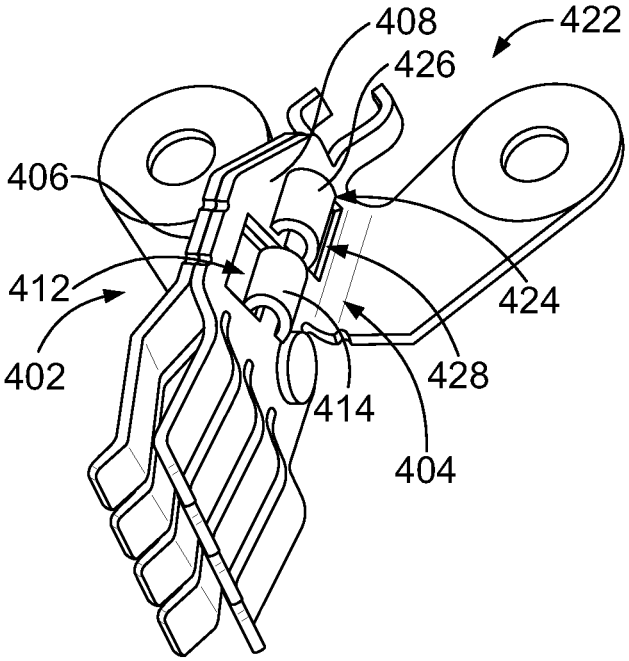
FIG. 10 is a perspective view of a contact assembly in accordance with one embodiment that includes the contact springs of FIG. 8.

FIG. 10 is a perspective view of a contact assembly 422 that includes the contact springs 402, 404. Although not shown, the contact assembly 422 is configured to be received by a connector housing to form a power connector. In FIG. 10, the contact assembly 422 includes the locking feature 412 and also a locking feature 424 that is formed in a similar manner as the locking feature 412. As shown, the localized portion 414 extends through the window 416 and is folded over to engage the spring base 408. Likewise, a localized portion 426 of the spring base 406 may be deformed to extend through a window 428 of the spring base 408 and folded over to engage the spring base 408. As shown, the localized portions 414, 426 are folded in opposite directions.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the subject matter described and/or illustrated herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A power connector comprising:

a pair of discrete contact springs configured to electrically engage a conductive component, each of the contact springs comprising a contact body having opposite inner and outer side surfaces and a contact edge that extends between the inner and outer side surfaces, the contact body being shaped to form a spring base and a mating portion;

wherein the spring bases of the contact springs are joined by a locking feature, the locking feature including a localized portion of at least one of the spring bases, the localized portion frictionally engaging the other spring base to interlock the spring bases;

wherein each of the mating portions extends from the corresponding spring base, the mating portions being separated by a receiving space and configured to engage the conductive component when the conductive component is inserted into the receiving space.

2. The power connector of claim 1, wherein the locking feature includes a plurality of locking features that join the spring bases, wherein at least two of the locking features are proximate to a base seam formed by the spring bases, the mating portions extending from the base seam.

3. The power connector of claim 1, wherein the pair of contact springs include first and second contact springs, the first contact spring including a body projection formed from the localized portion, the spring base of the second contact spring including a body recess, the body projection extending into the body recess and directly engaging the spring base of the second contact spring to interlock the spring bases.

4. The power connector of claim 3, wherein the body projection frictionally engages a surface that defines the body recess.

5. The power connector of claim 4, wherein the body recess has a recess opening along the inner side surface of the second contact spring, the body projection having a distal punch profile, the punch profile being greater than the recess opening to prevent removal of the body projection.

6. The power connector of claim 3, wherein the body recess is a window, the body projection extending through the window and directly engaging the outer side surface of the second contact spring.

7. The power connector of claim 1, wherein the contact springs include first and second contact springs, the locking feature being a co-punched feature in which the spring base of the first contact spring is punched into the spring base of the second contact spring to form the locking feature.

8. The power connector of claim 1, wherein the contact springs are shaped from corresponding contact blanks, the contact blanks being stamped from sheet metal and having identical profiles.

9. The power connector of claim 1, wherein each of the mating portions includes a plurality of contact fingers, the contact fingers configured to engage and be deflected by the conductive component.

10. The power connector of claim 1, wherein the contact springs also include respective mounting portions that are configured to couple to a power supply.

11. The power connector of claim 1, wherein the power connector is a busbar connector configured to engage a busbar in the receiving space and each of the contact springs is configured to transmit at least 200 A.

12. The power connector of claim 1, wherein the contact springs are directly joined without fastening hardware and without melting of the contact springs.

13. A power connector comprising:

discrete first and second contact springs configured to electrically engage a conductive component, each of the first and second contact springs comprising a contact body having opposite inner and outer side surfaces and a contact edge that extends between the inner and outer side surfaces, wherein the inner side surfaces of the first and second contact springs are positioned side-by-side along an interface;

wherein the first and second contact springs are joined by a plurality of co-punched locking features, each of the locking features including a localized portion of one of the first and second contact springs that is stamped into, and thereby deforms, a localized portion of the other of the first and second contact springs.

14. The power connector of claim 13, wherein each of the first and second contact springs is shaped to include a mating portion and a spring base, the mating portions opposing each other with a receiving space therebetween, the spring bases being joined by the locking features.

15. The power connector of claim 14, wherein each of the mating portions includes a plurality of contact fingers, the contact fingers configured to engage and be deflected by the conductive component.

16. The power connector of claim 13, wherein the localized portions of the locking features do not include the contact edge.

17. The power connector of claim 13, wherein the first and second contact springs are shaped from corresponding contact blanks, the contact blanks being stamped from sheet metal and having identical profiles.

18. The power connector of claim 13, wherein the contact springs include respective mounting portions that are configured to couple to a power supply.

19. The power connector of claim 13, wherein the power connector is a busbar connector configured to engage a busbar and each of the contact springs is configured to transmit at least 200 A.

20. The power connector of claim 13, wherein the contact springs are directly joined without separate hardware and without melting of the contact springs.

* * * * *